US006708785B1

(12) United States Patent
Russell et al.

(10) Patent No.: US 6,708,785 B1
(45) Date of Patent: Mar. 23, 2004

(54) FLUID CONTROLLED ADJUSTABLE DOWN-HOLE TOOL

(76) Inventors: Mark Alexander Russell, Thorn House, Low Bradfield, Sheffield (GB), S61 LB; Andrew Ollerenshaw, 133 Dunkerly Road, Loxley, Sheffield (GB), S61 RB ( * ) Notice: Subject to any disclaimer, the term of this patent is extended or adjusted under 35 U.S.C. 154(b) by 0 days.

(21) Appl. No.: 09/914,912

(22) PCT Filed: Mar. 6, 2000

(86) PCT No.: PCT/GB00/00775

§ 371 (c)(1),
(2), (4) Date: Nov. 21, 2001

(87) PCT Pub. No.: WO00/53886

PCT Pub. Date: Sep. 14, 2000

(30) Foreign Application Priority Data

Mar. 5, 1999 (GB) ..... 9905050

(51) Int. Cl.[7] ..... E21B 7/06
(52) U.S. Cl. ..... 175/321; 175/325.5; 166/240
(58) Field of Search ..... 175/73, 76, 321, 175/323, 325.5; 166/237, 240

(56) References Cited

U.S. PATENT DOCUMENTS 5,794,694 A * 8/1998 Smith, Jr. ..... 166/212

FOREIGN PATENT DOCUMENTS

GB 2369136 * 5/2002

* cited by examiner

*Primary Examiner*—William Neuder
(74) *Attorney, Agent, or Firm*—Keeling Hudson LLC; Kenneth A. Keeling

(57) ABSTRACT

An adjustable down-hole tool, for example a drill-string stabiliser (10), comprises a body (12) having a through bore (16). A mandrel (18) is rotationally fixed but axially movable in the body, the mandrel being movable by fluid pressure in the tool against the action of a first return spring (44) between a first, activated position and a second deactivated position. A sleeve (66) is between shoulders (68, 69) on the body and mandrel. Castellations (18*a,b*, 69*a,b*) are on the mandrel and facing edge or edges of the sleeve so that, when the castellations are in phase the mandrel is prevented from travelling from said first to second position and when they are out of phase they interdigitate and the mandrel is not prevented from travelling from said first to second position. A control piston (36) is slidable in the mandrel, being movable by fluid pressure in the tool against the action of a second return spring (50). The piston is axially slidable with respect to said sleeve and rotationally fixed with respect thereto. A circumferential barrel cam (56) is defined on the piston, a cam follower (58) being disposed in the mandrel but within the confines of the barrel cam so that axial movement of the piston with respect to the mandrel results in corresponding rotation of the piston with respect to the mandrel.

41 Claims, 10 Drawing Sheets

10
12
14
16
18
19
20
22
23
23'
24
25
26
27
28
30
31
32
33
34
36
37
38
42
44
46
48
50
52
54
56
58
66
68
100
110
B
V
IV
II

FLUID CONTROLLED ADJUSTABLE DOWN-HOLE TOOL

CROSS-REFERENCE TO RELATED APPLICATIONS

This applications claims the benefit of application Ser. No. 9905050.2 filed in Great Britain on Mar. 5, 1999.

STATEMENT REGARDING FEDERALLY SPONSORED RESEARCH OR DEVELOPMENT

Not Applicable.

BACKGROUND OF THE INVENTION

1. Field of the Invention

This invention relates to adjustable down-hole tools employed in the oil and gas drilling industry.

2. Description of the Related Art

Drill string stabilisers, under reamers and fishing tools are some of the down hole tools that require activation when they are in a given position down hole to make them operative, and deactivation when they are to be withdrawn, or repositioned or indeed simply to go into a different operating condition.

Taking stabilisers as an example, these tools centralise drill strings with respect to the hole drilled. They normally comprise a sub assembly in the drill string. The stabiliser has a plurality of blades, (usually three and usually spirally arranged), whose edges are adapted to bear against the bore-hole. The blades are not complete around a circumference of the drill string so that the return route for drilling mud pumped down the bore of the drill string is not blocked. In order to control the direction of drill bits, it is sometimes required that the stabiliser has variable diameter. Pistons in the blades are extendable to give the stabiliser a maximum diameter, which ensures that the drill string is central in the bore-hole. The drill bit, assuming the stabiliser is close behind the drill bit, is thus kept straight. However, if the pistons are withdrawn, then gravity can deflect the drill string so that it alters the inclination of the hole.

EP-A-0251543 describes a slabiliser that is activated by weight on the stabiliser from the drill string above it. Weight, or absence thereof, switches the stabiliser between activated and de-activated positions. The weight acts on a mandrel slidable in the bore of the stabiliser, which mandrel has ramps against which wedge-surfaces on the bases of the pistons slide. A mechanical detent is overcome by a compressive force on the stabiliser greater than a threshold value, so that unless substantial changes in weight act on the stabiliser, switching does not occur. This means that some variation in weight is permissable without changing the activation of the stabiliser. However, it is known that excessive changes in weight can occur unintentionally, possibly resulting in accidental activation and deactivation of the stabiliser.

It has been suggested to employ a rise in mud pump pressure to move the mandrel in the stabiliser. Changes in pressure switch the mandrel between different positions. Such a system is described in EP-A-0190529, in which a differential piston cooperates with a flow restrictor so that, if the fluid pressure rises beyond a low threshold, the piston (or flow restrictor) moves to rapidly and substantially increase the pressure differential across the piston which then drives the mandrel to activate the stabiliser. As a subsidiary feature the mandrel rotates on each stroke because the pads have pins which follow a barrel cam defined around the mandrel, which barrel cam has different steepness ramps so that the pads are extended different amounts. Unintentional variations in fluid pressure might also cause premature activation or deactivation.

GB-A-2263923 discloses a stabiliser control arrangement in which the object is to not be dependent on either fluid pressure or weight on the bit to maintain a stabiliser setting. This is achieved by lifting the drill string to positively disengage the locking mechanism, and then fluid pressure is employed to determine the stabiliser piston position. At the appropriate pressure the drill string is lowered to engage a lock, whereupon subsequent changes in fluid pressure have no effect on stabiliser position.

GB-A-2251444 has essentially the same aims as GB-A-2263923, except that, here, check valves prevent operation or deactivation of the stabiliser pads unless the pressure of the pump fluid exceeds or falls below upper and lower threshold values.

EP-A-0661412 has an arrangement similar to EP-A-190529. The position of a control piston determines the pressure drop across the mandrel which therefore controls the position of the mandrel. The control piston has a barrel cam in which a pin of the housing slides, so that the piston is constrained to follow a course determined by the track. A junction in the track is provided so that, at an intermediate pressure, if the pressure is reversed the pin does not return to its stating point but goes up a branch to a lesser (or greater) extent than its starting point. The stabiliser is activated between upper and lower pressures and that the pressure be taken from one level to an intermediate level whereupon the direction of pressure change is reversed.

GB-A-2314868 describes an arrangement in which the mandrel is hydraulically operated between operative and inoperative positions A first shoulder on the body of the stabiliser in which the mandrel slides has a serrated face. A facing shoulder on the body has a clutch face which is also set Between the two faces is a sleeve which is axially fixed but rotationally freely slidable on the mandrel. On the edge of the sleeve facing the serrated edge of the body is series of knobs to engage the serrations and rotate the sleeve through a small angle when the sleeve is axially pressed against the serrations. On its other edge, it has a series of fingers to engage the clutch face and either catch on ridges of the clutch face, which are provided with stops to prevent further rotation of the sleeve, or they miss the stops and hit a sloping serration of the lower shoulder causing further rotation of the sleeve until its fingers coincide with long slots in the shoulder whereupon the sleeve permits the mandrel to go to its operative position.

Consequently, as pressure is alternated and the mandrel moves back and forth, when it first moves down, for example, it may rest on the ridges of the clutch face and prevent the mandrel from going to its operative position When the pressure is released and the mandrel rises the knohs on the sleeve hit the serrations and turn the sleeve through a small angle; enough so that on the next stroke of the mandrel the fingers on the sleeve do not stay on the ridges. Instead, the fingers slide down the serrations of the clutch face and drop into slots therein. This movement takes the mandrel into its operative position. Finally on the return stroke, when the knobs again contact the serrated face the sleeve again rotates, repeating the cycle.

A problem with this arrangement, and with EP-A-0661412 is that the pressure which activates the stabiliser must be greater, of course, than the return force provided by springs, for example, which springs must themselves be very substantial in order to guarantee deactivation and overcome any jamming tendency which could occur through external pressure on the pistons. Consequently, there is wear on the components which are rotating, or causing the rotation, since they are simultaneously subject to substantial axial loads. Moreover, in the case of GB-A-2314868, because the fingers are the same components which result in rotation of the sleeve, they cannot be as substantial as their loading, particularly in an extended position, would ideally want them to be. Thus they may break.

GB-A-2314868 also discloses application of the mechanism described therein in relation to under reamers.

It is therefore an object of the present invention to provide a down-hole tool activation arrangement which does not suffer firm, or at least mitigates these or other problems.

BRIEF SUMMARY OF THE INVENTION

In accordance with the present invention, there is therefore provided an adjustable down-hole tool comprising a body having a through bore;

a mandrel axially movable in the body, the mandrel being movable by fluid pressure in the tool against the action of a first return spring between a first, activated position and a second deactivated position;

a sleeve between a shoulder on the body and the mandrel;

at least two sets of castellations, one on one of said shoulder and said mandrel and the other on a facing edge of the sleeve so that, when the castellations are in phase the mandrel is prevented from travelling foam said first to second position and when they are out of phase they interdigitate and the mandrel is not prevented from travelling from said first to second position; and means to rotate the sleeve relative to the mandrel between said in-phase and out-of-phase positions;

characterised in that said means comprises a control piston slidable in the mandrel, being movable by fluid pressure in the tool against the action of a second return spring; and in that one of said piston and mandrel is rotationally fixed with respect to the body.

Preferably, it is said mandrel which is rotationally fixed with respect to the body. Preferably, said control piston is axially slidable with respect to said sleeve and rotationally fixed with respect hereto Preferably, a circumferential barrel cam is defined in one of sad piston and mandrel, a cam follower being disposed in the other thereof, the follower being within the barrel cam so that axial movement of the piston with respect to the mandrel results in corresponding rotation of the piston with respect to the mandrel. In this case, the barrel cam may be shaped so that movement of the piston in one axial stroke and return thereof results in rotation of the sleeve from a said in-phase position to a said out-of-phase position or vice versa. Said castellations are preferably angularly spaced by a phase angle and said stroke and return of the piston results in rotation of the sleeve by said phase angle.

When said mandrel is in said deactivated position, a rise in hydraulic pressure in the tool preferably results in movement of the piston before movement of the mandrel. Said first return spring may be sufficiently stronger than said second return spring to ensure that, when said mandrel is in said deactivated position, a rise in hydraulic pressure in the tool results in movement of the piston before movement of the mandrel. Alternatively, or in addition, a spring loaded detent may be provided between said mandrel and body to retain the mandrel in said deactivated position until a threshold hydraulic pressure has been exceeded, which pressure is greater than that required to move said piston. Said detent may comprise a plunger in a radial bore of the mandrel or body, spring biassed against a lip of the body or mandrel, respectively. Said lip may be of a circumferential groove around the body.

Preferably, the plunger has a through bore connecting the space between the mandrel and body with a space behind the plunger so that hydraulic effects are substantially eliminated. Moreover, there are preferably a plurality of said detents arranged around the circumference of the mandrel. This reduces any moment on the mandrel relative to the body.

The mandrel will usually have a through bore and be scaled to the body abut first and second circumferences, the first being a larger circumference upstream, in terms of fluid flow through the tool, of the second, smaller circumference. Thus hydraulic forces act on the mandrel relative to the body urging the mandrel in a downstream direction.

The piston preferably also has a through bore and is sealed to the mandrel about third and fourth circumferences, the third being a larger circumference upstream, in terms of fluid flow through the tool, of the fourth, smaller circumference. Thus hydraulic forces likewise act on the piston relative to the mandrel also urging the piston in a downstream direction.

Preferably, the piston extends from the mandrel and is sealed to the body. Indeed, the seal between the body and mandrel about said second circumference, and the seal between the piston and mandrel about said fourth circumference, may comprise an integrated seal between the piston and the body.

In said activated position, the bore of the piston preferably engages a plug in the bore of the body to create a flow restriction and consequent back pressure detectable to indicate the position of the tool.

Said tool can be a drill-string stabiliser, in which case said mandrel has wedge surfaces to engage corresponding surfaces on radially disposed pistons slidable in the body, whereby, when the mandrel moves from said deactivated to said activated position, the pistons extend from the body inn sing the working diameter of the stabiliser.

BRIEF DESCRIPTION OF THE SEVERAL VIEWS OF THE DRAWINGS

The invention is further described hereinafter, by way of example, with reference to the accompanying drawings, in which.

DETAILED DESCRIPTION OF THE INVENTION

Figures 1A, 1B, 1C:
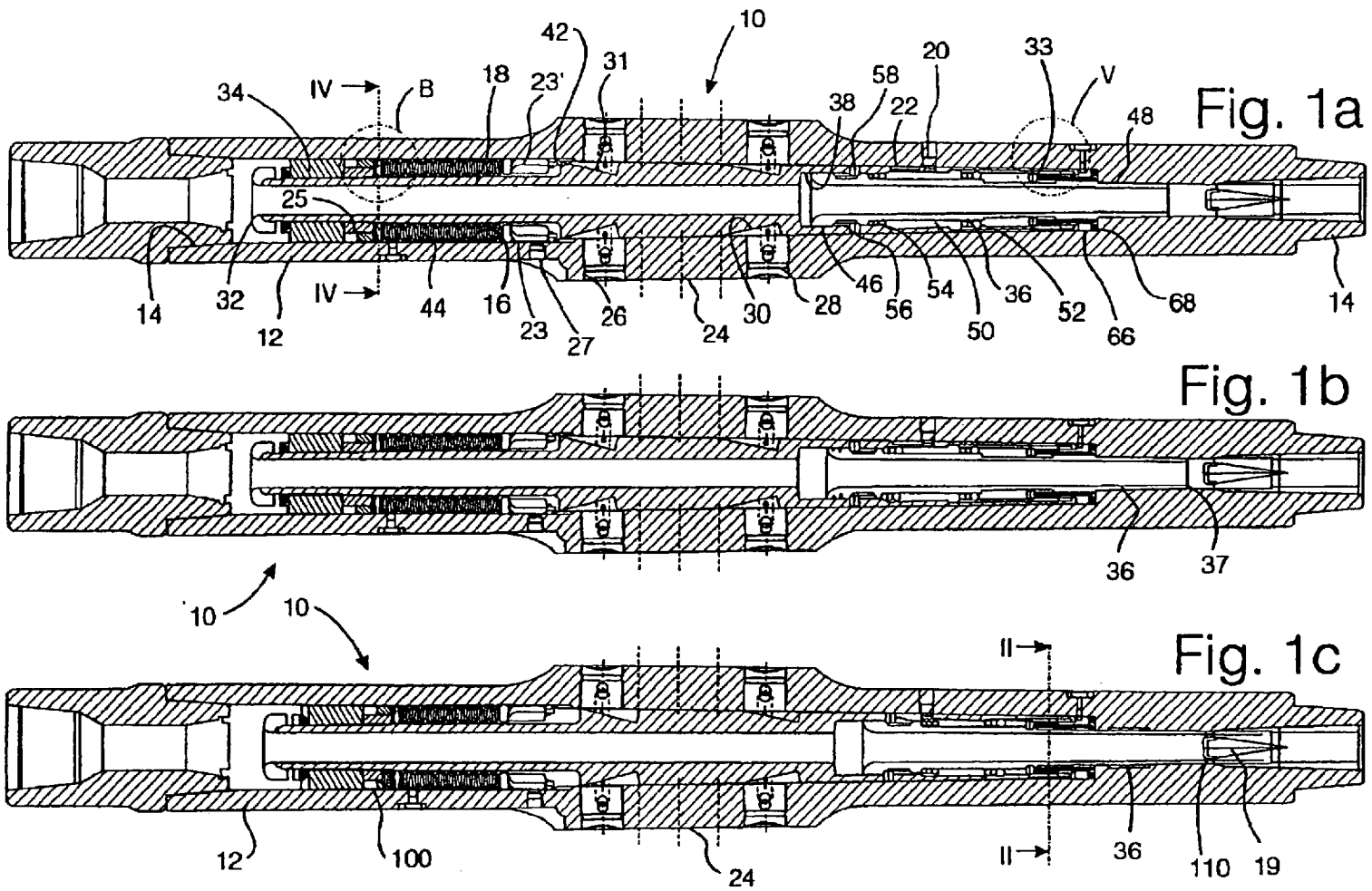
FIGS. 1*a, b* and *c* are side sections through the tool in accordance with the present invention, in different positions thereof.

In the drawings, a stabiliser 10 comprises a body 12 connectable to a drill string (not shown) by means of male and female connectors 14 at either end thereof. A bore 16 extends from one end of the body 12 to the other, to permit flow of mud to lubricate the drill bit (not shown) at the end of the string. Slidable in the bore 16 is a mandrel 18 which is rotationally fixed therein by virtue of a stud 20 in the body 12 which extends into a slot 22 in the mandrel 18. The slot 22 extends axially of the mandrel 18 permitting axial movement thereof within the body 12.

Spiral blades 24 are defied on the surface of the body 12 and bear against the surface of the bore hole (not shown) being drilled to guide the drill bit. The blades permit the return passage of drilling mud by being spaced around the body 12. The blades 24 have radial bores 26 defined in spaced relation along each blade 24. Within each bore 26 is a piston 28 urged radially inwards by springs (not shown). The base of each piston is formed with a wedge surface 30 against which a wedge 31 of the mandrel 18 acts. Thus, if the mandrel moves rightwardly in the drawings, the pistons 28 are thrust radially outwardly projecting beyond the circumference of the stabiliser 10 defined by the blades 24, (see FIG. 1*c*). In this way, the working diameter of the stabiliser increases with the faces of the pistons 28 bearing against the wall of the bore hole.

Figure 4A:
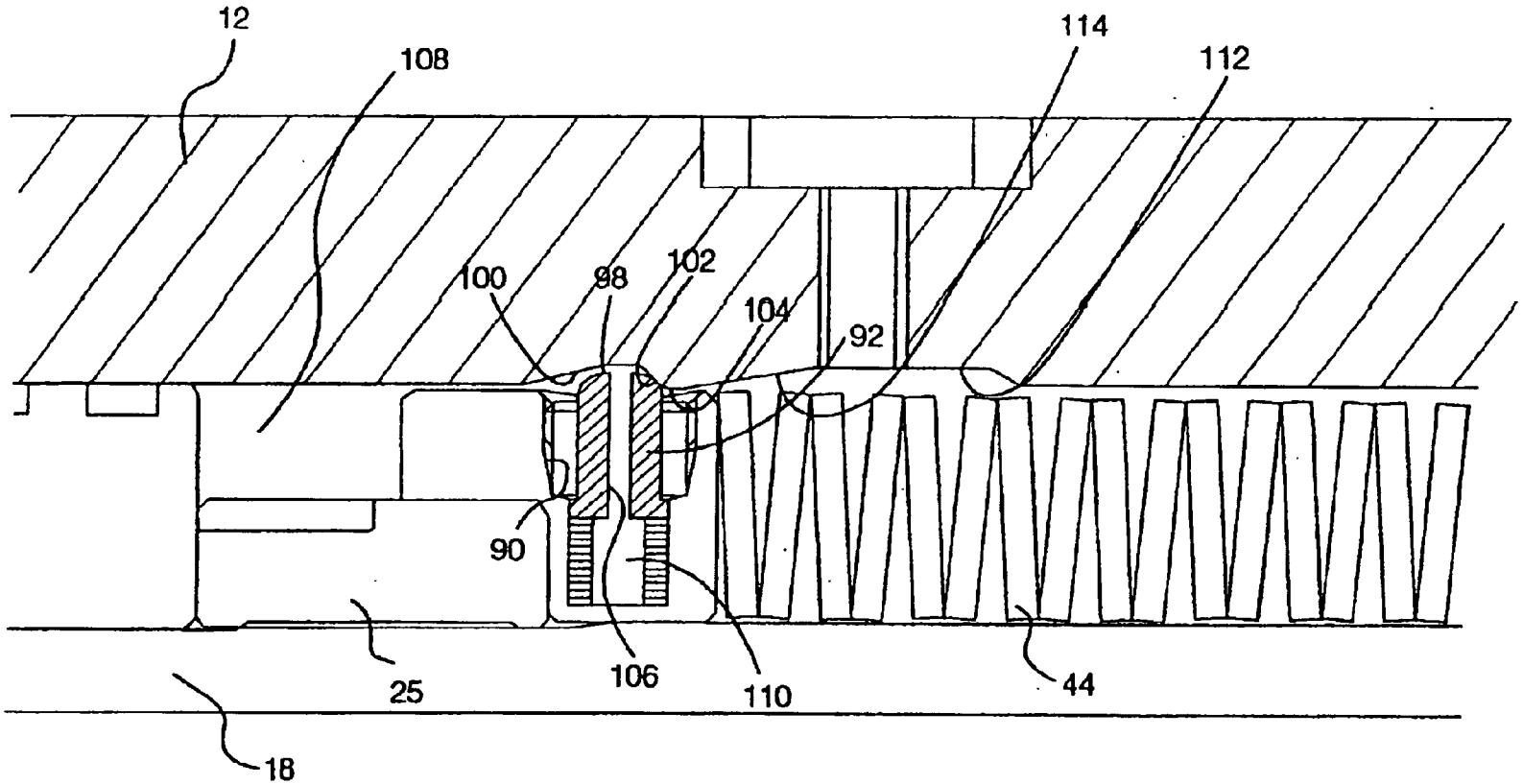
FIGS. 4*a* and *b* are, respectively, an expanded side view of detail B in FIG. 1*a*, and *a* side section on the line IV—IV in FIG. 1*a;*
Figure 4B:
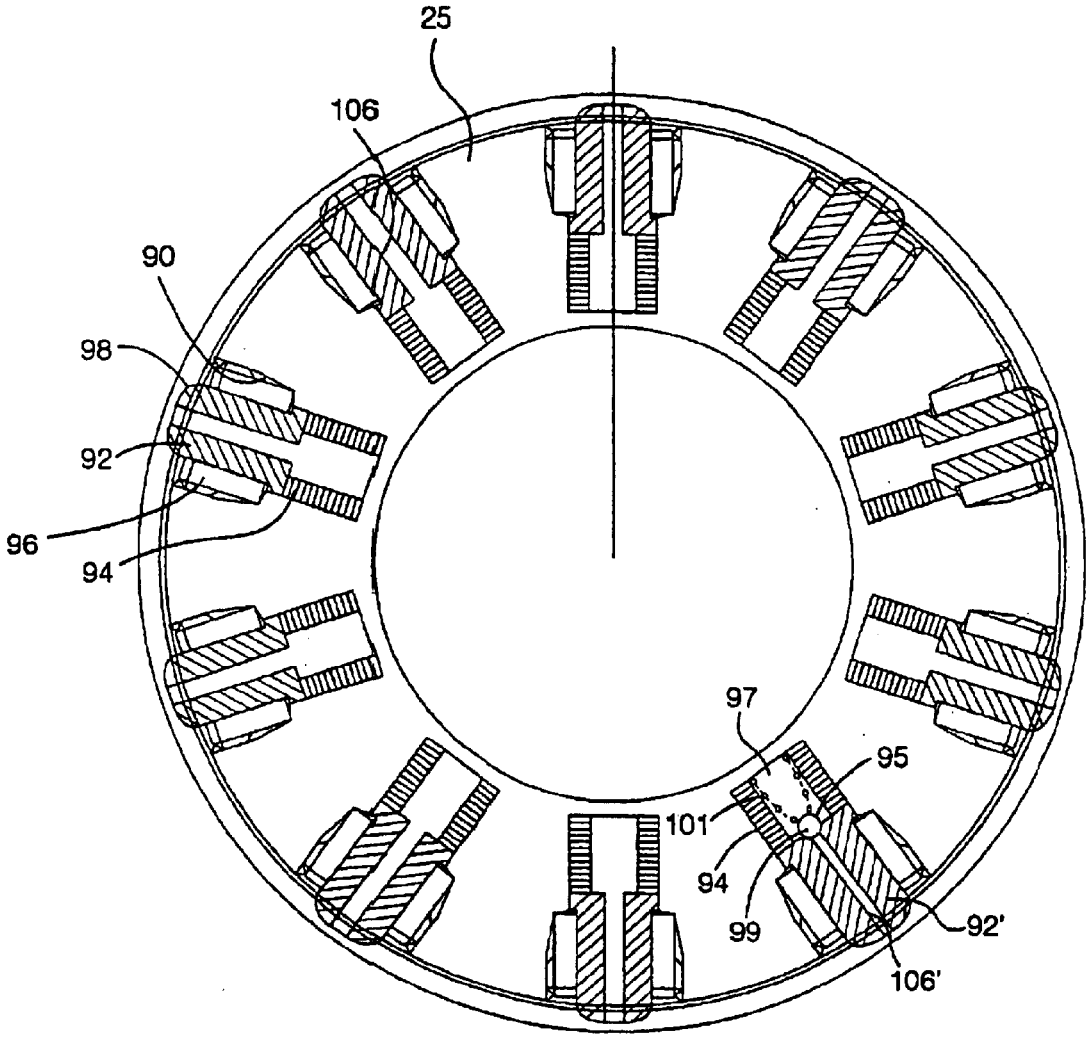

A collar 25 is screwed onto the mandrel 18 at its upstream end 32 (see also FIG. 4). Above the collar 25 is a seal sleeve 34 which is sealed both to the mandrel 18 and the bore 16 of the body 12. At its downstream end 33, the mandrel receives a control piston 36. The control piston is slidable in a bore 38 of the mandrel which extends from its upstream end 32 to its downstream end 33. The control piston carries seals 46 which seal the piston with respect to the mandrel 18. The piston 36 extends out of the end 33 of the mandrel 18 and is itself sealed at 48 to the bore 16 of the body 12.

As far as the body 12 is concerned, the mandrel and piston are a single unit, and it can be seen that the circumference of the sleeve seal 34 in the body 12 is much larger than the circumference of the seal 48 around the piston 36. Consequently, hydraulic pressure of the mud in the tool 10 results in a larger downward force acting at the end 32 of the mandrel 18 via the seal sleeve 34, than acting in the reverse direction on the piston 36 through its seals 48.

Springs 44 act between a shoulder 42 in the body 12 (via compensation device 23 described further below) and the collar 25 on the mandrel 18, urging the mandrel in the upstream direction. Should the pressure differential be such that the force acting on the mandrel exceeds the return force of the sprung 44, the mandrel will move rightwardly in the drawing.

Likewise, hydraulic pressure acting on the control piston 36 across the circumference of its seals 46 to the mandrel result in a downward force on the piston 36 because the circumference of the seal 48 to the body 12 is smaller than seal circumference 46. Again, springs 50 act between shoulder 52 in the mandrel 18 and shoulder 54 on the piston 36 to urge the piston in an upstream direction. Again, should the hydraulic pressure be such that the force of the springs 50 are overcome, the piston 36 will move rightwardly in the drawings.

Figure 3A:
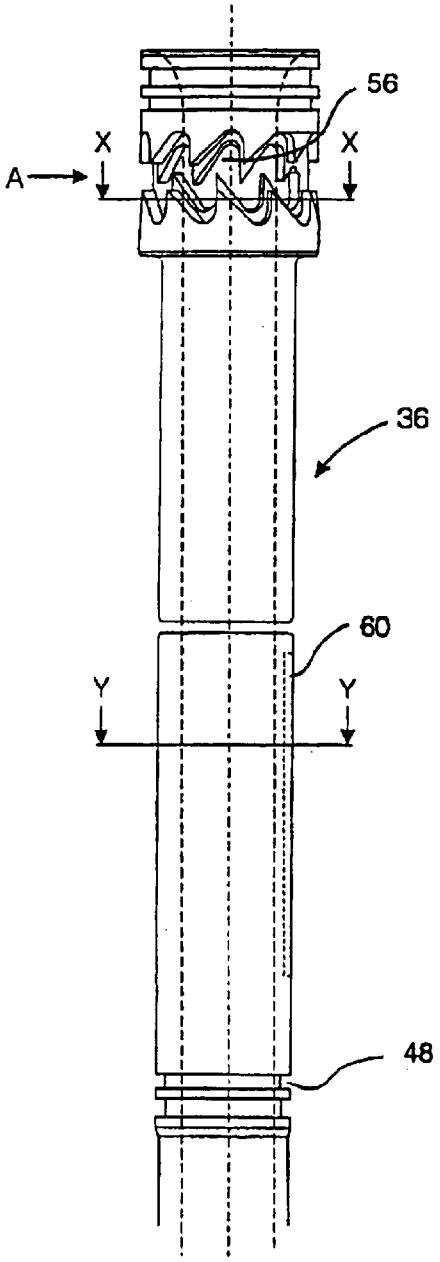
FIGS. 3*a, b, c* and d are, respectively, a side view of a control piston of the tool of FIG. 1, a section on the line X—X in FIG. 3*a*, a section on the line Y—Y in FIG. 3*a* and a detailed view of the barrel cam in the direction of arrow A in FIG. 3*a;*
Figure 3D:
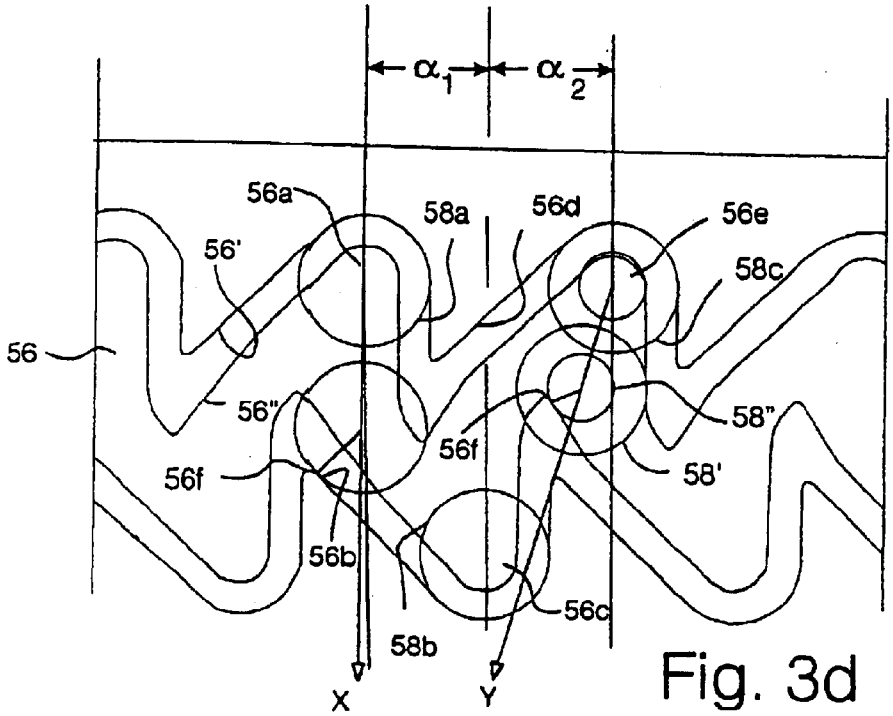

The piston has a barrel cam 56 defined in its surface (see FIG. 3*a*). Pins 58 in the mandrel are received within the confines of the barrel cam 56 so that movement of one relative to the other forces the piston to follow a course defined by the barrel cam 56. If the mandrel is considered, for the moment, to be stationary, then, as hydraulic pressure increases in the bore 38 of the mandrel 18, the piston 36 begins movement from left to right (with reference to FIG. 1*a*). Suppose the pins 58 start at position 58*a*, for example (see FIG. 3*d*), where they lie at the base of a first notch 56*a* of the barrel cam. They will thus move, relatively to the barrel cam 56, until they contact the opposite wall thereof at 56*b*. Further axial movement of the piston 36 then only occurs when the piston rotates through a small angle $\alpha_1$, so that the pin 58 effectively moves to position 58*b* in notch 56*c* on the opposite side of the barrel cam 56 from notch 56*a*.

Should the hydraulic pressure be released, ream springs 50 force the piston 36 leftwardly in the drawings (FIG. 1*a–c*). The pin 58 is obliged to follow a course from position 58*b* in notch 56*c* of the barrel cam 56, axially until the opposite wall of the barrel cam 56*d* is contacted. Thereafter, further axial movement of the piston can only occur on further rotation of the piston In this event, the pin moves to the base of notch 56*e* on the same side of the barrel cam 56 as notch 56*a*. In this movement, the piston has rotated through a further angle $\alpha_2$, which is not necessarily the same as $\alpha_1$. Nevertheless the sum $(\alpha_1+\alpha_2)$ is equal to $\alpha$, the angle of rotation of the piston 36 on one complete return stroke thereof in relation to the mandrel 18.

A subsidiary feature of the barrel cam 56 and pins 58 is that the pins 58 have a large diameter section 58' and a small diameter end 58". The barrel cam has a correspondingly wide slot 56' and a deeper, narrow slot 56", so that the wide slot 56' accommodates the large diameter section 58' of the pin 58, while the narrow slot 56" accommodates the thin pin end 58". The purpose of this is that a wide slot is inevitably somewhat coarse compared with a narrow slot, which can be precise. On the other hand, a wide slot with a large diameter pin significantly reduces point loads, both on the pin and cam surface it is following. Given that the control piston is spring loaded, it inevitably resists rotation due to frictional forces, although these can be alleviated, for example, by employing a thrust bearing between the spring 50 and piston 36. However, even with this measure, if only a coarse cam surface 56' land large pin 58' is employed, then, in moving from notch 56*a* to contact surface 56*b*, a rotational drift back in the direction of Arrow X in FIG. 3*d* of only 1° can be permitted. Any greater drift, which would generally be caused by the sprig having been "wound up" by previous movements, would cause contact of the pin 58' with point 56*f* of the cam 56', such that secure guidance of the pin to notch 56*c* could not be guaranteed. Because slot 56" can be more precise, however, the permitted angle of drift can be much greater, such as 15° (see Arrow Y in FIG. 3*d*), while still ensuring that the pin is guided correctly and rotation of the piston 36 in the correct direction is guaranteed. At the same time, however, it is only during these extreme situations that loading only occurs through the narrow slot 56" and thin pin end 58". Most of the time, and indeed mostly all the time when thrust bearing are employed, both surfaces 56' and 56" are contacted by both pin parts 58' and 58", so that wear on the pin 58 and slot 56 is minimised, even though accurate guidance is ensured.

Figure 5A:
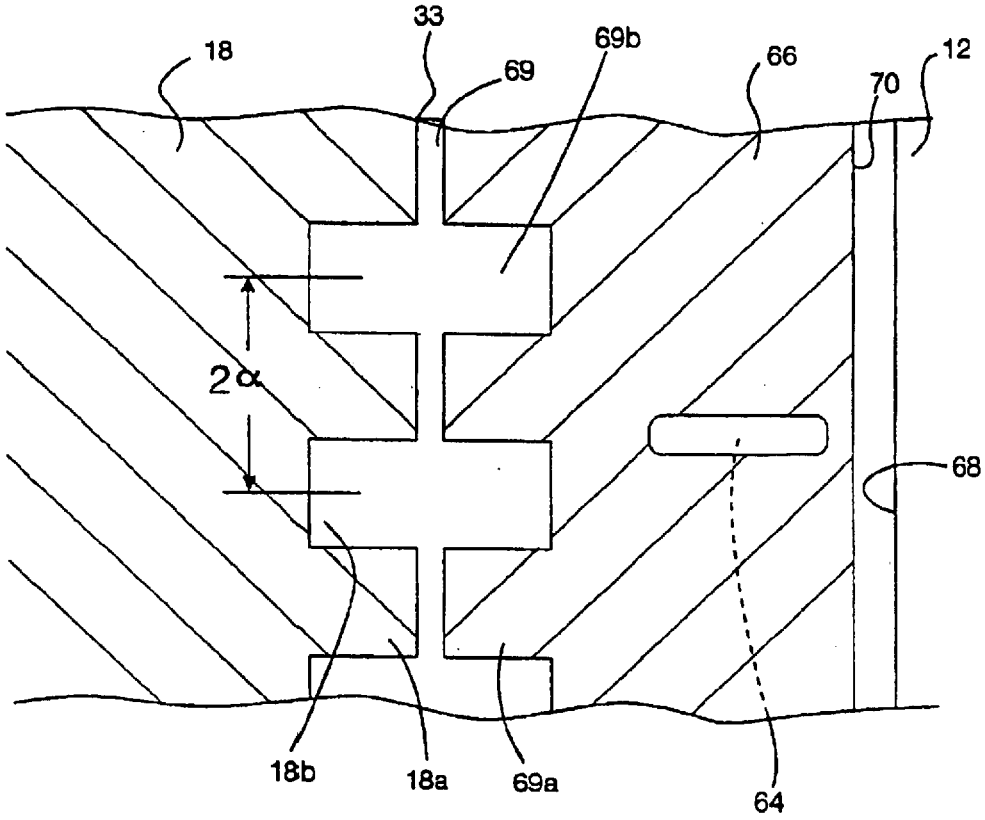
FIGS. 5*a* and *b* are, respectively, a view in the direction of arrow A in FIG. 5*b*, and an expanded view of detail V in FIG. 1*a;*

As shown in FIG. 3*a* and *c*, the piston 36 has a longitudinal slot 60 in which is received a key 64 of a castellated sleeve 66 (see FIGS. 5*a* and *b* for more details).

The sleeve 66 is received between a shoulder 68 of the body 12 and end 33 of the mandrel 18. The end 33 of the mandrel 18 is castellated having fingers 18*a* and slots 18*b*. The end 69 of the sleeve 68 is likewise castellated having fingers 69*a* and slots 69*b*. When the fingers 18*a*,69*a* of the mandrel and sleeve are in phase with one another, as shown in FIG. 5*a*, then rightward movement of the mandrel 18 in the drawings, is limited, with the fingers 18*a*,69*a* abutting one another and the other end 70 of the sleeve 66 abutting shoulder 68 of the body 12.

On the other hand, however, when the sleeve 66 is out of phase with respect to the mandrel 18, fingers 18*a* face slots 69*b* and fingers 69*a* face slots 18*b* so that, when the mandrel 18 moves rightwardly in the drawings, the castellations on the mandrel and sleeve interdigitate so that further rightward movement of the mandrel 18 is possible than when the castellations are in phase. The angular separation of the fingers and slots in the mandrel and sleeve is arranged to be the same angle a (or multiples thereof), as described above.

Consequently, when the piston makes a complete return stroke serving to rotate the sleeve 66 through the angle $2\alpha$, the sleeve 66 moves from an in-phase position to an out-of-phase position, or vice versa.

Figure 2:
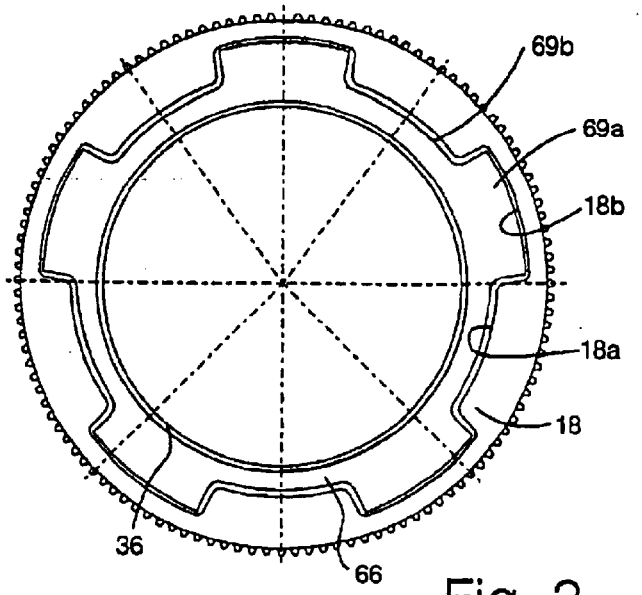
FIG. 2 is a section on the line II—II in FIG. 1*c;*
Figure 3B:
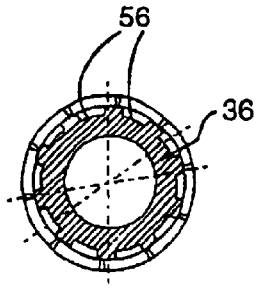
Figure 3C:
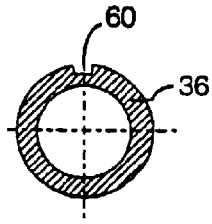

Although FIGS. 5*a* and *b* show fingers 18*a*,69*a* and slots 18*b*, 69*b* extending across the thickness of both the mandrel 18 and sleeve 66 respectively, in FIG. 2, it can be seen that the respective fingers and slots extend only across a portion of the thickness of each element 18,66. Both arrangements are functionally identical, the arrangement in FIG. 2 merely being mechanically more sound.

Figure 6:
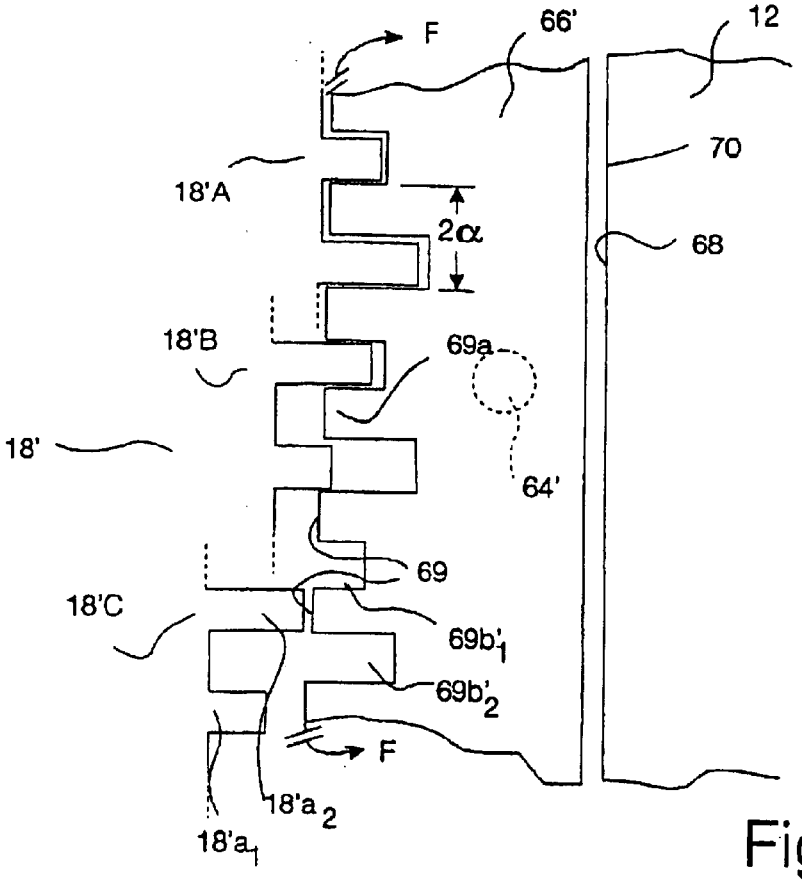
FIG. 6 is a view similar to FIG. 5*a*, but of an alternative embodiment of the preset invention.

Turning now to FIG. 6, an alternative arrangement is shown to that described above with reference to FIG. 5*a*. Here, the sleeve 66' has alternate slots 69*b'* which have different depths (shallow, 69*b'*, and deep, 69*b'*$_2$). Similarly, the mandrel 18' has alternate fingers 18*a'* which are correspondingly short, 18*a'*, and long 18*a'*$_2$. Such an arrangement necessitates, of course, an even number of fingers and slots around the sleeve 66' and mandrel 18', which has a consequent effect ion the barrel cam 56. In the previous embodiment, there were five fingers/slots around the periphery (as shown in FIG. 2), meaning that angle $2\alpha$ was 72° of rotation Here, there are preferably six fingers/slots, so that angle $2\alpha$ is 60°.

Figure 5B:
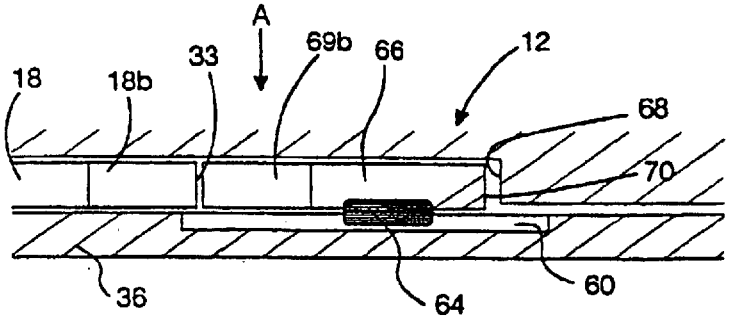

The result of varying depth of fingers 18*a'* and slots 69*b'* is that mandrel 18 can have three positions instead of just two, that is to say an intermediate position between deactivation and full activation. In FIG. 6 at its top, the mandrel is shown in its fully activated position 18'A, in which long fingers 18*a'*$_2$ coincide with deep slots 69*b'*$_2$, so that this corresponds entirely with at activated position of the previous embodiment, At the bottom of FIG. 6, the fingers 18*a'*$_2$ coincide with the fingers 69*a* of the sleeve 66' (which fingers are all level, as in the embodiment described with reference to FIG. 5*a*), so that the mandrel is in its deactivated position 18'C, again corresponding with the deactivated position of the previous embodiment and as shown in FIG. 5. However, in the middle of FIG. 6, there is shown the intermediate position 18'B in which long fingers 18*a'*$_2$ coincide with shallow slots 69*b'*$_1$, with the result that the pistons 28 are only displaced radially outwardly to a lesser extent.

Returning to FIG. 1*a* and with reference also to FIG. 4*a*, and *b*, the mandrel has on the collar 25 a series of pockets 90 in which a plunger 92 is disposed. Springs 94 press the plunger radially outwards, the plungers being retained in the pockets 90 by threaded retainers 96. The head 98 of each plunger 92 is received within a circumferential groove 100 in the body 12. It is therefore apparent that rightward movement of the mandrel in the body 12 is only possible if the plungers 92 are first pressed radially inwardly. For this purpose groove 100 is provided with an angled cam surface 102. Thus when the mandrel is piss sufficiently strongly in the rightward direction in the drawings, the returning force of the springs 94 may be overcome and the plungers (92) are pressed radially inwardly so that they pas over lip 104 of the groove 100. In order to ensure that hydraulic effects do not influence the operation of this detent represented by the plungers 92, each plunger has a through bore 106 connecting space 108 between the mandrel 18 and body 12 with space 110 behind the plunger 92 and within the pocket 90.

While the detent plungers are shown spring loaded, the same result could be achieved with the plungers forming pistons as shown at 92'. Fluid behind the pistons here resists their radially inward displacement until the fluid leaked out around the sides thereof. Nevertheless, a return spring 94 is still required, and moreover a return flow path 106' guarded by a check valve 95 is also required. The check valve comprises a ball 99 and spring 101 and it inhibits fluid leaving the space 97 behind the piston 92', but permits inflow when the springs 94 push the piston 92' out.

In operation of the stabiliser 10, therefore, and beginning with the positions shown in FIG. 1*a*, a user at ground level who wishes to increase the working diameter of the stabiliser 10 increases the flow and pressure of drilling mud down the bore of the drill string so that hydraulic pressure begins to sat on the components within the stabiliser tool. Because of the detent represented by the plungers 92, he mandrel is at first prevented from moving. However, the piston 36 ha[ n]o such detent and so commences to move rightwardly in FIG. 1*a* against the pressure of spring 50. Rightward movement of the piston 36 is thus accompanied by rotation thereof through the angle $\alpha_1$, which, for the sake of argument, rotates the sleeve 66, via the key 64 sliding in the slot 62 of the piston 36, to the position shown in FIG. 5*a* where the fingers 69*a* of the sleeve 66 are in phase with the fingers 18*a* of the mandrel 18. It must be borne in mind that the mandrel 18 is rotationally fixed in the body 12 by pin 20 received in slot 22. Thus, even if the pressure in the tool 10 should continue to rise sufficient to release the detent plungers 92 from the slot 100, the mandrel 18 cannot move much further rightwardly than shown in FIG. 1*a* by virtue of the fingers 18*a* at the end 33 of the mandrel contacting the fingers 69*a* of the sleeve 66. Indeed, such movement as there is merely takes up the clearance between the fingers 18*a*, 69*a*, and between end 70 of the sleeve 66 and shoulder 68.

However, should it be desired by the user that the stabiliser operate in its maximum working diameter, the operator reduces the pump press so that the spring 44 returns the mandrel (to the extent that this is necessary) to the position shown in FIG. 1*a*. The springs 50 also return the piston from the position shown in FIG. 1*b* to that shown in FIG. 1*a*. In doing so, the piston woes through the further angle $\alpha_2$. On the next occasion, therefore, that the hydraulic pressure is increased again so that the piston 36 moves once again towards the position shown in FIG. 1*b*, and it rotates through a further angle $\alpha_1$, then, on this occasion, the castellations on the mandrel 18 and sleeve 66 will be out of phase. Consequently, once the hydraulic pressure rises sufficiently to force the mandrel past the detent plungers 92, the mandrel will move fully rightwards as shown in FIG. 1*c*, with the respective castellations on the mandrel and sleeve interdigitating.

In this position, as shown in FIG. 1*c*, an end 37 of the piston 36 moves into close proximity with a plug 19 in the body 12, with the result that a substantial constriction 110 is created in the fluid flow. The operator at ground level is then advised that the mandrel has moved to its activated position by a sudden rise in pump working pressure.

Here, as shown in FIG. 1*c*, the pistons are pressed radially outwardly so that they stand proud of the surface of the blades 24 and increase the working diameter of the stabiliser 10.

It will be apparent to the skilled reader that, m moving within the body 12, the mandrel 18 and piston 36 compress the space between the body and mandrel/piston and defined by the seats 34,48 and primarily occupied by the space containing springs 44 and 50 and sleeve 66. This space is filled with hydraulic oil and is isolated both from fluid pressure external of the stabiliser 12, as well as hydraulic pressure internally of the bore 38. Thus firstly there is a requirement to provide for relief of the oil in that space as the mandrel moves and compresses that space. Secondly, since the hydraulic pressures both internally and externally are intense, a means to match pressure in that space is desirable in order to avoid disruption of the seals.

For this purpose, pressure relief chamber 23 is provided This chamber is of known construction per se and consequently only brief description is required here. Chamber 23 comprises an annular bellows 23' which, internally, is in fluid communication with the space and springs 44 and 50 and sleeve 66, and externally is in communication with the outside environment through port 27. Thus the pressure in the space referred to must correspond with the outside pressure. The chamber 23 is itself sealed to the bore 16 of the body 12, but not to the mandrel 18. The movement of the mandrel and compression of the space around spring 44 is also, indeed primarily, taken up by radially outward movement of the pistons 28.

Referring again to FIG. 4*c*, on rightward movement of the mandrel 18, the detent plungers 92 move into over lip 104 into a shallow, groove 112 in the body 12, which has a much less steep return face 114. Consequently springs 44, once hydraulic pressure has been released, have no problem in compressing plungers 92 to return them over lip 104.

By this arrangement, two connected effects are experience. The first is that the piston 36 moves with very little extraneous loading upon it. Thus the mandrel 18 is held in position by the detent plungers 92 so that sleeve 66 is freely rotatable between the end 33 of the mandrel 18 and the shoulder 68 on the body 12 by movement of the piston 36. Consequently there is little wear on the barrel cam 56 or the pins 58 received therein. Secondly, because the fingers 18*a*,69*a* have no function beyond meeting one another and resisting the heavy fortes imposed by the hydraulic pressure, or inter-digitating when out of phase, they can be substantial components with little need to provide mutually sliding surfaces, for example. Thus they are able to be made as structurally strong components less liable to fail, without adversely affecting operation of the stabiliser.

It is intended that the present invention operates (that is to say toggles between positions) at pressures well below normal operating pressures of the drill string, which may be in the region of 500 psi or more. At these pressures, the control piston is designed to remain in the position shown in FIG. 1*b* or 1*c* relative to the mandrel, the latter being in either of its activated or deactivated positions (the fingers and slots on the mandrel and sleeve being entirely in-phase or entirely out-of-phase). On sing from zero pressure, both the mandrel and control piston would begin to move together but, due to the strength of the springs and their design the piston can be arranged to have completed its stroke before the mandrel has substantially begun to move. In any event, as mentioned above, the dent mechanism actively prevents the mandrel moving until the forces on it exceed a predefined limit. Indeed, that limit is arranged so that once the detent has been released, the mandrel moves from its stat position to its final position without further increase in pressure. In other words it is a clean switching action.

Figure 8A:
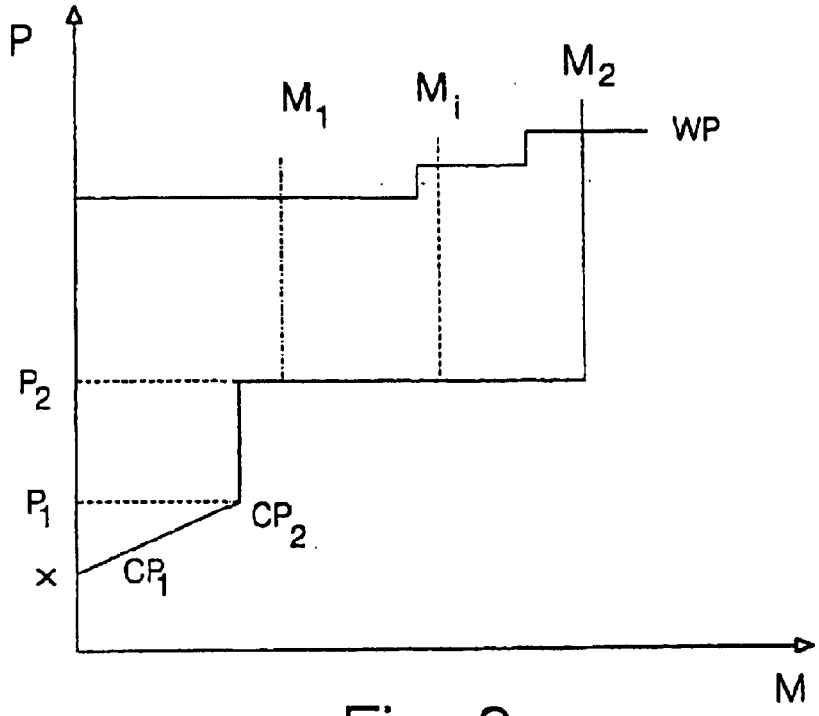
FIGS. 8*a* and *b* are graphs showing changes in mud pump pressures with mandrel position and time, respectively.

This is illustrated in FIG. 8*a* which is a grape of mud pump pressure (P) versus position (M) of the end 37 of the piston 36 with respect to its position shown in FIG. 1*a*. As pressure increases from some value x above zero (there will be a preset loading of the spring 50) to $P_1$, the control piston moves gradually from $CP_1$ to $CP_2$, ie to the position shown in FIG. 1*b*. Thereafter there is no movement until the pressure reaches $P_2$, whereupon the detent mechanism is overcome and the mandrel moves from position $M_1$ to $M_2$, being the position shown in FIG. 1*c* without further change in pressure P. Of course, should the fingers 18*a*,69*a* be in phase, then the mandrel will stay at $M_1$ and further increase in pressure will follow the phantom line in FIG. 8*a*. If the stabiliser is as the alternative embodiment described with reference to FIG. 6, then the mandrel may move instead to position $M_i$, being the intermediate position, and further increase in pressure will follow the dashed line in FIG. 1*a*. In any event, all lines will reach working pressure WP, except that it will be less when the mandrel is in position $M_1$ than $M_2$, because of the constriction 110 caused by plug 19.

Turning to FIGS. 7*a* to 7*d*, there is shown an arrangement of the piston 36' and plug 19' which assists in signalling to the user the position that the mandrel is in, and thus the state of activation of the stabiliser 10, when the stabiliser is modified as described with reference to FIG. 6.

Figure 7A:
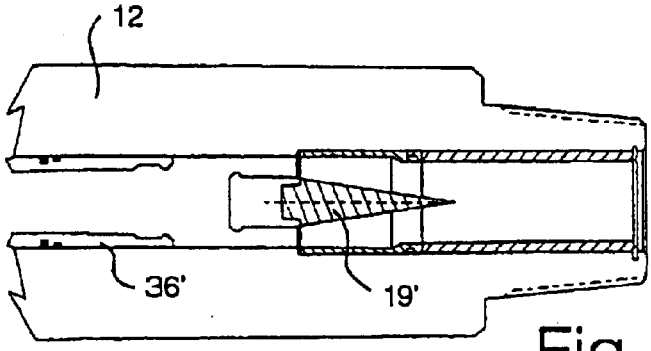
FIGS. 7*a* to *d* are enlargements of one end of the stabiliser according to the embodiment of the present invention shown in FIG. 6, and wherein development of a signalling constriction is shown.
Figure 7B:
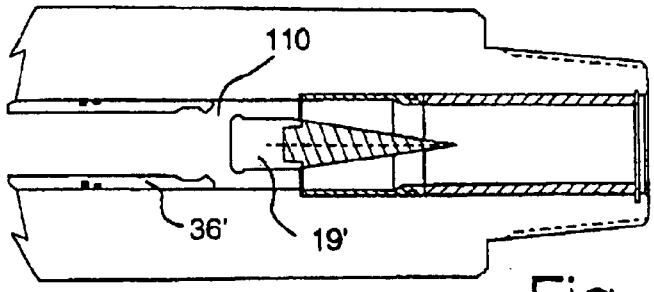
Figure 8B:
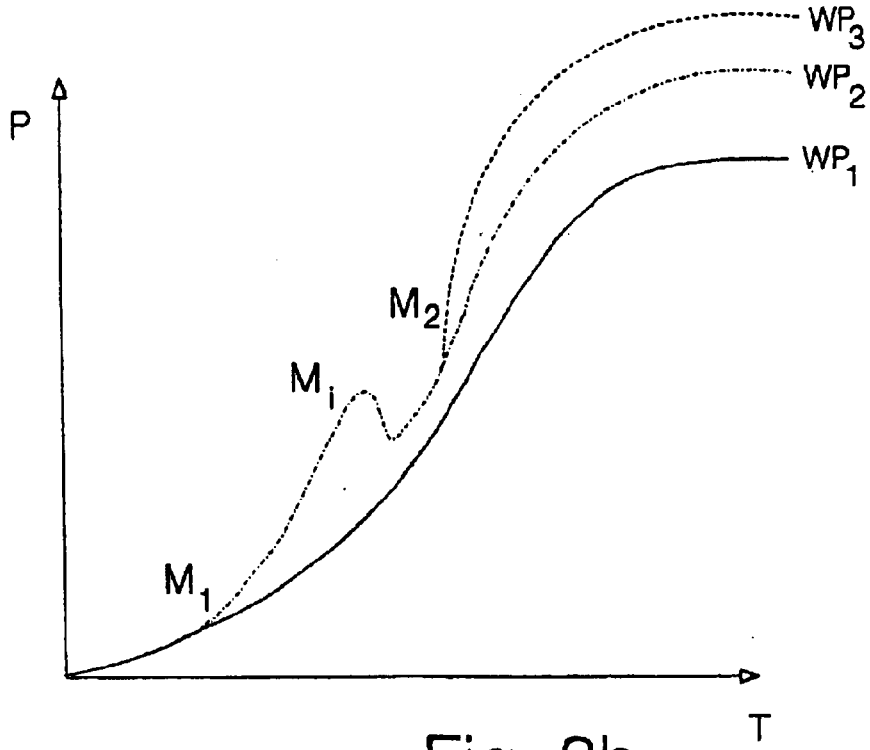

In FIG. 7*a*, the piston 36' is in position $CP_1$, ie no pump pressure. In FIG. 7*b*, it has moved to position $CP_2/M_1$, where constriction 110 is negligible and not yet having any significant effect. A graph of pressure P versus time T is shown in FIG. 8*b*, where it can be seen that reaching position $M_1$ has no precise impact on the shape of the developing pressure. However, if the mandrel stays in the position $M_1$, then the pressure continues to develop to working pressure $WP_1$ along the solid line in FIG. 8*b*.

Figure 7C:
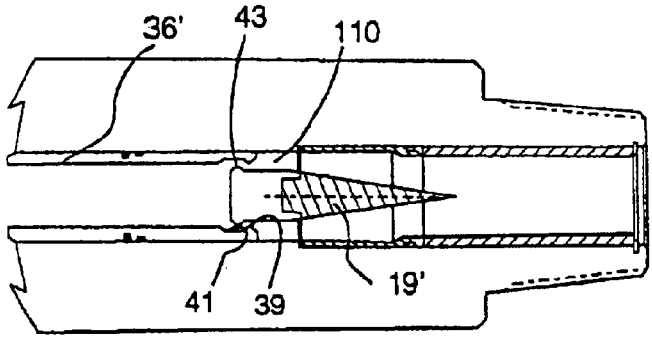

If, on the other hand, the mandrel moves to the intermediate position $M_i$, then the piston moves to the position shown in FIG. 7*c* where an internal lip 39, which is formed by a circumferential groove 41 formed in the bore of the piston 36, passe over a lip 43 on the plug 19'. Here, not only has the constriction 110 formed, but also, in moving to this position a very tight constriction was temporarily formed while the lips 39,43 overlapped. This results in a strong pressure pulse (at $M_i$ in FIG. 8*b*) before the pressure continues rise to $WP_2$, which is higher than $WP_1$ in view of the constriction 110.

Figure 7D:
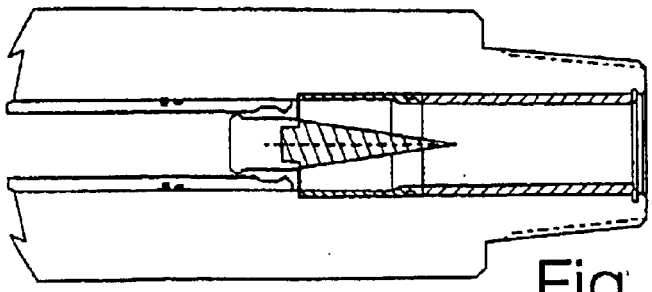

Finally, as the piston moves to the position shown in FIG. 7*d*, where the mandrel is in its fully activated position $M_2$, lip 43 moves over groove 41 and causes an even tighter constriction within the bore of the piston 36'. This further increases the pressure at $M_2$ in FIG. 8*b*, before the pressure continues to rise to $WP_3$ which is again higher than $WP_2$.

Thus by this mechanism not only are the final working pressures different for the different working positions of the mandrel 18, but also a pressure pulse is experienced at each change of position. Indeed, with sensitive detection equipment at the surface and connected to the drilling mud pressure line, it may even be possible to dispense with the constriction 110 per se, and simply rely on the pulses to detect position rather than final working pressures.

Figure 9A:
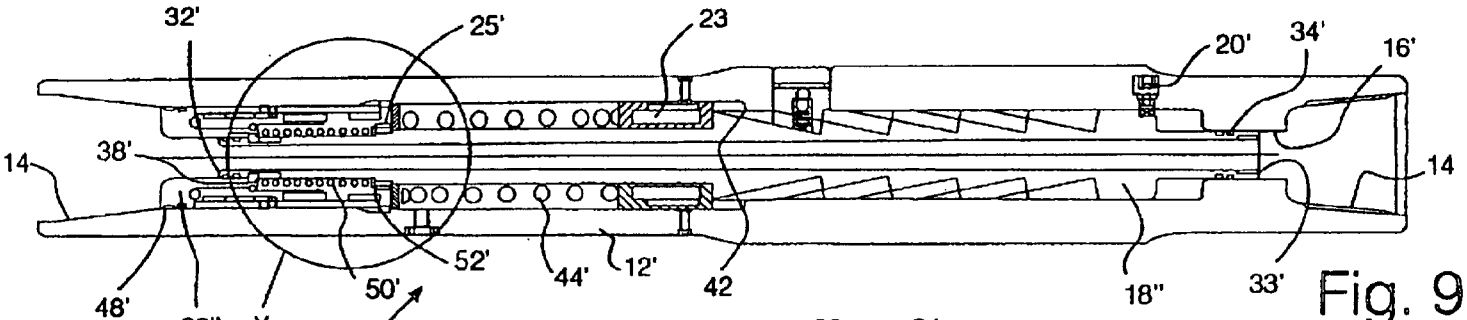
FIGS. 9*a, b* and *c* are side sections through an alternative embodiment of a tool in accordance with the present invention.
Figure 9B:
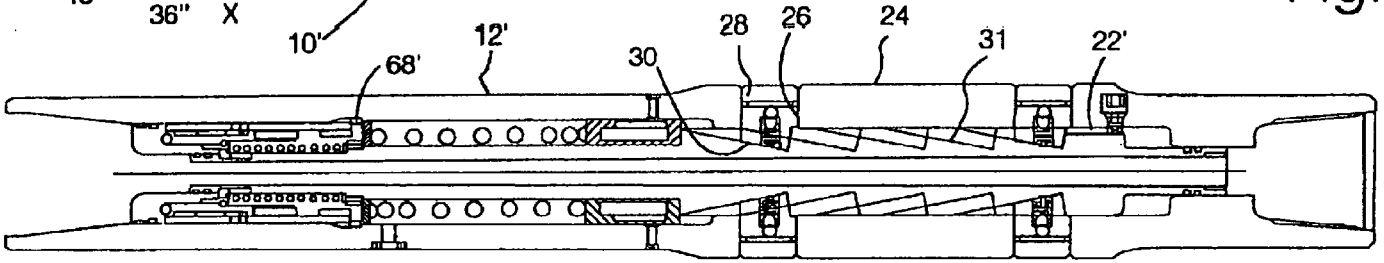
Figure 9C:
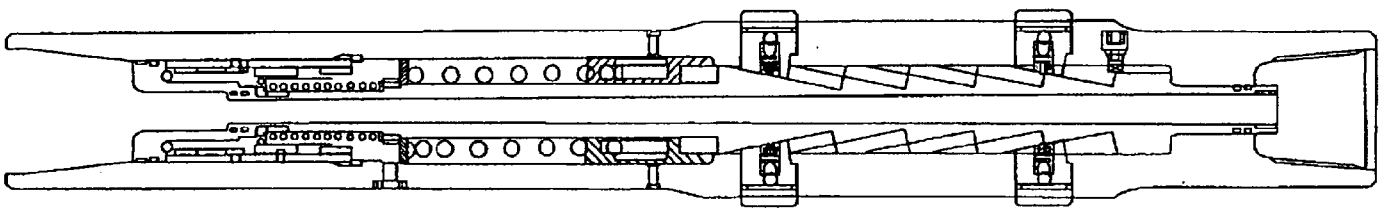
Figure 10:
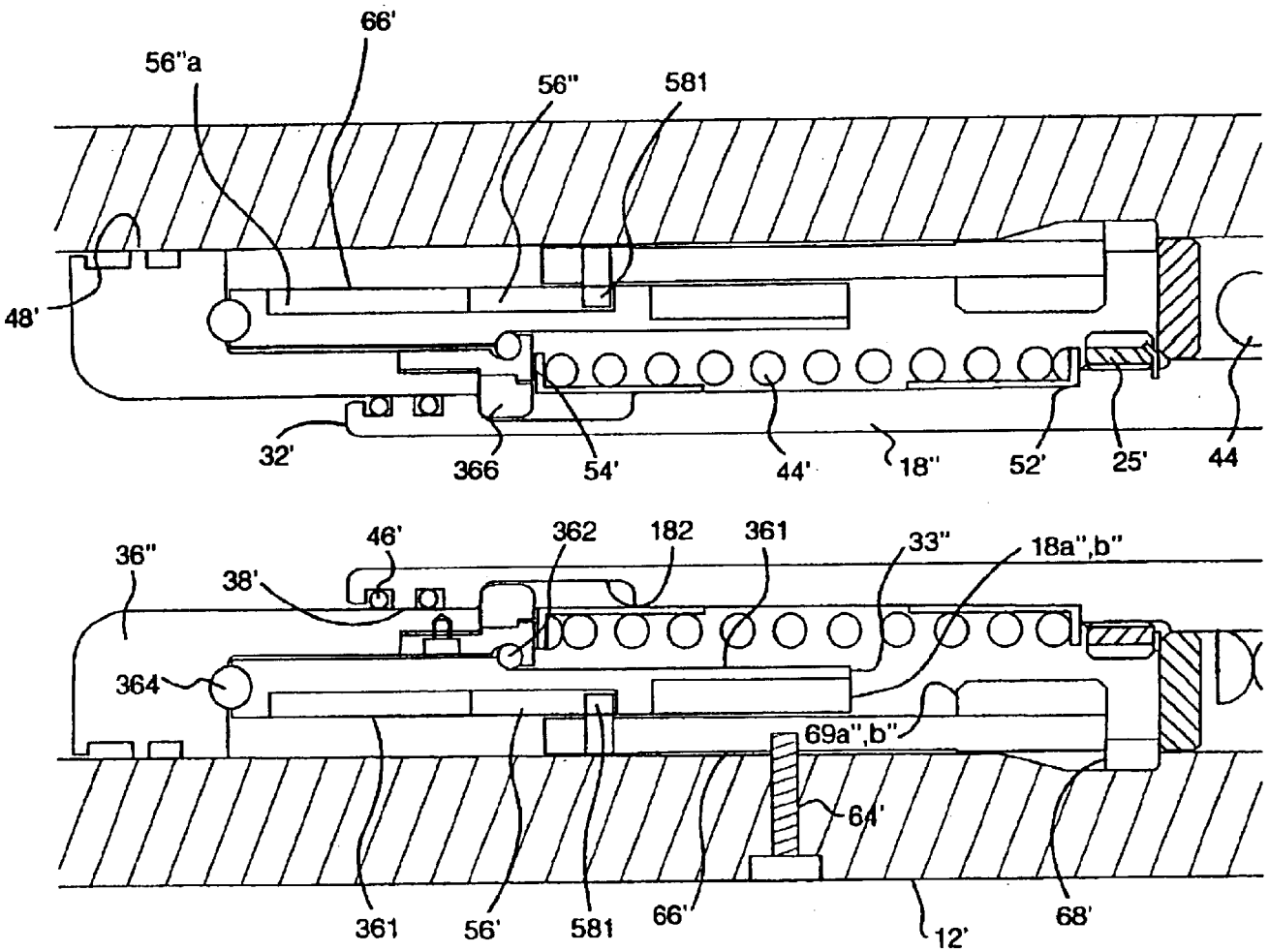
FIG. 10 is a detailed view of the inset marked X on FIG. 9*a*.

Finally, FIGS. 9 and 10 illustrate a different embodiment of the present invention in which the control arrangement for movement of the mandrel is moved to the upstream end of the stabiliser. In these figures, parts with equivalent function to the embodiment described with reference to FIG. 1 are given the same references numeral, except for the addition of an apostrophe (') or double apostrophe (") if the element in question differs in any way from previous embodiments.

In this embodiment, the mandrel 18" is a sliding fit inside the piston 36", which is itself a sliding fit in the bore of the body 12'. Instead of the piston rotating, here a component 361 of the piston rotates on it through beans 362, 364. The component 361 is rotationally mounted through bearings 362, 364 on the piston 36" and rotates relative thereto as the piston moves up and down the body 12'. The cam track 56" is formed on the surface of the component 361, whereas the cam follower pins 581 are mounted on sleeve 66', which is now effectively just a pat of the body 12'. The sleeve 66' is prevented from rotating relative to the body by a bolt 64' or by similar means. A mandrel drive ring 366 is carried by the piston 36" and rides in an annular groove 182 in the mandrel 18". The ring 366 is in two part and is returned by collar 54' screwed onto the end of piston 36".

When mud pressure increases, the piston 36" moves rightwardly in the drawing and, depending on the rotational position of the Sleeve 66', fingers 69*a*"/18*a*" on the sleeve 66' and component 361 either oppose one another or interdigitate with each other falling into slots 18*b*"/69*b*". If they interdigitate, then drive ring 366 hits the end of slot 182 and the piston 36" drives the mandrel rightwardly in the drawing to set it in its full gauge, activated position. If, however, the fingers 69*a*"/18*a*" face one another then even if mandrel 18" slides rightwardly relative to piston bore 36' under the influence of mud pressure (which is minimised by substantial equality of diameter of the mandrel upstream, to the piston, (seal 46') on the one hand, and downstream, to the body, (seal 34') on the other hand), drive ring 366 prevents rightward movement of the mandrel 18" and the mandrel remains in its under gauge or deactivated position of the stabiliser.

It is to be noted that here, the cam track 56" and the component 361 move with the mandrel and therefore cam extensions 56"*a* in an axial direction are needed, at least in positions where the fingers 69*a*"/18*a*" interdigitate and the axial movement of the piston 36' and component 361 is extensive relative to the sleeve 66'.

What is claimed is:

1. An adjustable down-hole tool comprising a body having a through bore;

a mandrel axially movable and rotationally fixed in the body, the mandrel being movable by fluid pressure in the tool between a first, activated position and a second deactivated position;

a sleeve, said sleeve limiting movement of,aid mandrel between said positions;

at least two sets of castellations, one set on the sleeve and the other set on an edge of the mandrel facing the castellations on the sleeve so that, when the castellation are in phase, the mandrel is prevented from travelling from said first to second position and when they are out of phase they interdigitate and the mandrel is not prevented from travelling from said first to second position; and means to rotate the sleeve relative to the facing edge between said in-phase and out-of-phase positions; wherein said means comprises a control piston slidable in or on the mandrel and in the body and being movable by fluid pressure in the tool against the action of a first return spring and in which said piston is axially slidable with respect to said sleeve and rotationally fixed with respect thereto.

2. A tool as claimed in claim 1, in which said tool is a drill-string stabiliser and said mandrel has wedge surfaces to engage corresponding surfaces on radially disposed pistons slidable in the body, whereby, when the mandrel moves from said deactivated to said activated position, the pistons extend from the body increasing the working diameter of the stabiliser.

3. A tool as claimed in claim 1, in which a circumferential barrel cam is defined in one of said piston and mandrel or body, a cam follower being disposed in the other of said piston and mandrel or body, the follower being within the barrel cam so that axial movement of the piston with respect to the mandrel or body, as the case may be, results in corresponding rotation of the piston with respect to the body or mandrel.

4. A tool as claimed in claim 3, in which said tool is a drill-string stabiliser and said mandrel has wedge surfaces to engage corresponding surfaces on radially disposed pistons slidable in the body, whereby, when the mandrel moves from said deactivated to said activated position, the pistons extend from the body increasing the working diameter of the stabiliser, and in which the barrel cam is shaped so that movement of the piston in one axial stroke and return thereof results in relative rotation of the sleeve and said facing edge from a said in-phase position to a said out-of-phase position or vice versa.

5. A tool as claimed in claim 4, in which said castellations are angularly spaced by a phase angle and said stroke and return of the piston results in relative rotation of the sleeve and said facing edge by said phase angle.

6. A tool as claimed in any of claim 3, in which said pin has a relatively thin diameter end, and said barrel cam comprises a wide groove to receive a large diameter section of the pin and a deeper, narrow groove within said wide groove to receive said thin end of the pin.

7. A tool as claimed in claim 1, in which one set of said castellations comprise an even number of alternating fingers and slots, and in which alternate fingers are longer than the remaining fingers, and the other set of castellations comprise the same number of alternating fingers and slots, and in which alternate slots are shorter than the remaining slots, whereby an intermediate position of the mandrel is defined when said longer fingers interdigitate with said shorter slots.

8. A tool as claimed in claim 1, in which, when said mandrel is in said deactivated position, a rise in hydraulic pressure in the tool results in movement of the piston before movement of the mandrel.

9. A tool as claimed in claim 1, in which said mandrel is moved by fluid pressure in the tool against the action of a second return spring, said second return spring being sufficiently stronger than said first return spring to ensure that, when said mandrel is in said deactivated position, a rise in hydraulic pressure in the tool results in movement of the piston before movement of the mandrel.

10. A tool as claimed in claim 8, in which a spring loaded detent between said mandrel and body retains the mandrel ill said deactivated position until a threshold hydraulic pressure has been exceeded, which pressure is greater than that required to move said piston.

11. A tool as claimed in claim 10, in which said detent comprises a plunger in a radial bore of the mandrel or body, spring biassed against a lip of the body or mandrel respectively.

12. A tool us claimed in claim 11, in which said lip is of a circumferential groove around the body.

13. A tool as claimed in claim 10, in which said plunger has a through bore connecting the space between the mandrel and body with a space behind the plunger so that hydraulic effects are substantially eliminated and it is said spring loading which primarily inhibits release of the detent.

14. A tool as claimed in claim 11, in which said plunger has a through bore connecting the space between the mandrel and body with a space behind the plunger, and a check valve in said bore only permitting flow of fluid into said space behind the plunger, whereby hydraulic forces primarily inhibit release of the detent.

15. A tool as claimed in claim 10, comprising a plurality of said detents arranged around the circumference of the mandrel.

16. A tool as claimed in claim 1, in which the mandrel has a through bore and is sealed to the body about first and second circumferences, the first being a larger circumference upstream, in terms of fluid flow through the tool, of the second, smaller circumference.

17. A tool as claimed in claim 16, in which the pistol has a through bore and is sealed to the mandrel about third and fourth circumferences, the third being a larger circumference upstream, in terms of fluid flow through the tool, of the fourth, smaller circumference.

18. A tool as claimed in claim 17, in which the piston extends from the mandrel and is sealed to the body.

19. A tool as claimed in claim 18, in which the seal between the body and mandrel about said second circumference, and the seal between the piston and mandrel about said fourth circumference, comprise an integrated seal between the piston and the body.

20. A tool as claimed in claim 17, which in said activated position, the bore of the piston engages a plug in the bore of the body to create a flow restriction and consequent back pressure detectable to indicate the activation of the tool.

21. A tool as claimed in claim 20, in which one set of said castellations comprise an even number of alternating fingers and slots, and in which alternate fingers are longer than the remaining fingers, and the other set of castellations comprise the same number of alternating fingers and slots, and in which alternate slots are shorter than the remaining slots, whereby an intermediate position of the mandrel is defined when said longer fingers interdigitate with said shorter slots, and in which the bore of said piston or the plug have sections of different diameter so that, in said activated, de-activated and intermediate positions of the mandrel, different constrictions are created so that different back pressures result.

22. A tool as claimed in claim 20, in which one set of said castellations comprise an even number of alternating fingers and slots, and in which alternate fingers are longer than the remaining fingers, and the other set of castellations comprise the same number of alternating fingers and slots, and in which alternate slots are shorter than the remaining slots, whereby an intermediate position of the mandrel is defined when said longer fingers interdigitate with said shorter slots, and in which said bore has a circumferential groove near its end and said plug has a circumferential lip, such that a pressure pulse is generated when said piston first engages said lip and when said lip first engages the bore of the piston beyond said groove.

23. A tool as claimed in claim 22, in which the bore of said piston or the plug have sections of different diameter so that, in said activated, de-activated and intermediate positions of the mandrel, different constrictions are created so that different back pressures result, and in which said groove and the bore of the piston provides said sections of different diameter so that said lip on the plug is either disengaged from said bore, engaged with said groove, or engaged with the bore of the piston in said de-activated, intermediate and activated positions of the mandrel respectively.

24. An adjustable down-hole tool comprising a body having a through bore;

a mandrel axially movable in the body, the mandrel being movable by a fluid pressure in the tool between a first, activated position and a second deactivated position;

a shoulder on the body;

a sleeve, said sleeve between the shoulder and the mandrel;

at least two sets of castellations, one set on one of said shoulder and mandrel and the other set on a facing edge or edges of the sleeve so that, when the castellations are in phase, the mandrel is prevented from, travelling from said first to second position and when they are out of phase they interdigitate, and the mandrel is not prevented from travelling from said first to second position; and means to rotate the sleeve relative to the mandrel between said in-phase and out-of-phase positions; wherein said means comprises a control piston slidable in the mandrel, being movable by fluid pressure in the tool against the action of a first return spring; and wherein one of said piston and mandrel is rotationally fixed with respect to the body.

25. An adjustable down-hole tool comprising a body having a through bore;

a mandrel axially movable in the body, the mandrel being movable by fluid pressure in the tool between a first, activated position and a second deactivated position;

a sleeve, said sleeve limiting movement of said mandrel between said positions;

at least two sets of castellations, one set on the sleeve and the other set on an edge facing the castellations on the sleeve so that, when the castellations are in phase, the mandrel is prevented from travelling from said first to second position and when they are out of phase they interdigitate and the mandrel is not prevented from travelling from said, first to second position; and mean to rotate the sleeve relative to the facing edge between said in-phase and out-of-phase positions wherein said means comprises a control piston slidable in or on the mandrel and in the body and being movable by fluid pressure in the tool against the action of a first return spring and wherein said facing edge is on the piston and in which said piston is axially and rotationally slidable with respect to said sleeve, which sleeve is rotationally fixed in the body.

26. A tool as claimed in claim 25, in which a circumferential barrel cam is defined in one of said piston and mandrel or body, a cam follower being disposed in the other of said piston and mandrel, or body, the follower being within the barrel cam so that axial movement of the piston with respect to the mandrel or body, as the case may be, results in corresponding rotation of the piston with respect to the body or mandrel, and in which said barrel cam and cam follower are disposed between said piston and sleeve, the sleeve being part of the body.

27. A tool as claimed in claim 26, in which a component is rotationally mounted on the piston and on which component one of said barrel cam and cam follower is mounted and on which said facing edge is disposed.

28. A tool as claimed in claim 25, in which said tool is a drill-string stabiliser and said mandrel has wedge surfaces to engage corresponding surfaces on radially disposed pistons slidable in the body, whereby, when the mandrel moves from said deactivated to said activated position, the pistons extend from the body increasing the working diameter of the stabiliser.

29. A tool as claimed in claim 25, in which a circumferential barrel cam is defined in one of said piston and mandrel or body, a cam follower being disposed in the other of said piston and mandrel or body, the follower being within the barrel cam so that axial movement of the piston with respect to the mandrel or body, as the case may be, results in corresponding rotation of the piston with respect to the body or mandrel.

30. A tool as claimed in claim 29, in which said tool is a drill-string stabiliser and said mandrel has wedge surfaces to engage corresponding surfaces on radially disposed pistons slidable in the body, whereby, when the mandrel moves from said deactivated to said activated position, the pistons extend from the body increasing the working diameter of the stabiliser, and in which the barrel cam is shaped so that movement of the piston in one axial stroke and return thereof results in relative rotation of the sleeve and said facing edge from a said in-phase position to a said out-of-phase position or vice versa.

31. A tool as claimed in claim 30, in which said castellations are angularly spaced by a phase angle and said stroke and return of the piston results in relative rotation of the sleeve and said facing edge by said phase angle.

32. A tool as claimed in any of claim 29, in which said pin has a relatively thin diameter end, and said barrel cam comprises a wide groove to receive a large diameter section of the pin and a deeper, narrow groove within said wide groove to receive said thin end of the pin.

33. A tool as claimed in claim 25, in which one set of said castellations comprise an even number of alternating fingers and slots, and in which alternate fingers are longer than the remaining fingers, and the other set of castellations comprise the same number of alternating fingers and slots, and in which alternate slots are shorter than the remaining slots, whereby an intermediate position of the mandrel is defined when said longer fingers interdigitate with said shorter slots.

34. A tool as claimed in claim 25, in which, when said mandrel is in said deactivated position, a rise in hydraulic pressure in the tool results in movement of the piston before movement of the mandrel.

35. A tool as claimed in claim 25, in which said mandrel is moved by fluid pressure in the tool against the action of a second return spring, said second return spring being sufficiently stronger than said first return spring to ensure that, when said mandrel is in said deactivated position, a rise in hydraulic pressure in the tool results in movement of the piston before movement of the mandrel.

36. A tool as claimed in claim 34, in which a spring loaded detent between said mandrel and body retains the mandrel in said deactivated position until a threshold hydraulic pressure has been exceeded, which pressure is greater than that required to move said piston.

37. A tool as claimed in claim 36, in which said detent comprises a plunger in a radial bore of the mandrel or body, spring biassed against a lip of the body or mandrel respectively.

38. A tool as claimed in claim 37, in which said lip is of a circumferential groove around the body.

39. A tool as claimed in claim 36, in which said plunger has a through bore connecting the space between the mandrel and body with a space behind the plunger so that hydraulic effects are substantially eliminated and it is said spring loading which primarily inhibits release of the detent.

40. A tool as claimed in claim 37, in which said plunger has a through bore connecting tile space between the mandrel and body with a space behind the plunger, and a check valve in said bore only permitting flow of fluid into said space behind the plunger, whereby hydraulic forces primarily inhibit release of the detent.

41. A tool as claimed in claim 36, comprising a plurality of said detents arranged around the circumference of the mandrel.

* * * * *